US008220432B2

(12) United States Patent
Iwata et al.

(10) Patent No.: US 8,220,432 B2
(45) Date of Patent: Jul. 17, 2012

(54) INTERNAL COMBUSTION ENGINE PISTON

(75) Inventors: Kazuya Iwata, Atsugi (JP); Seiichi Sue, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 267 days.

(21) Appl. No.: 12/720,891

(22) Filed: Mar. 10, 2010

(65) Prior Publication Data

US 2010/0229820 A1 Sep. 16, 2010

(30) Foreign Application Priority Data

Mar. 12, 2009 (JP) ..... 2009-058839

(51) Int. Cl.
*F02F 3/00* (2006.01)

(52) U.S. Cl. ..... 123/193.6

(58) Field of Classification Search ..... 123/193.6; 92/208, 239, 177
See application file for complete search history.

(56) References Cited

U.S. PATENT DOCUMENTS 5,894,824 A * 4/1999 Watanabe et al. ..... 123/193.6
6,073,602 A * 6/2000 Muta ..... 123/193.6
6,357,341 B1 * 3/2002 Watanabe et al. ..... 92/238
6,698,392 B1 * 3/2004 Kohnert et al. ..... 123/193.6
2008/0264376 A1 10/2008 Braig et al.

FOREIGN PATENT DOCUMENTS

JP 2-132834 U 11/1990
JP 3-89958 U 9/1991
JP 7-8541 U 2/1995
JP 10-159974 A 6/1998
JP 2008-190357 A 8/2008

OTHER PUBLICATIONS

Japanese Office Action dated Jul. 12, 2011 (five (5) pages).
Japanese Office Action dated Dec. 20, 2011 (three (3) pages).
Chinese Office Action including English translation dated Sep. 7, 2011 (Fourteen (14) pages).

* cited by examiner

*Primary Examiner* — M. McMahon
(74) *Attorney, Agent, or Firm* — Crowell & Moring LLP

(57) ABSTRACT

An internal combustion engine piston includes a piston crown, a thrust-side skirt, an anti-thrust-side skirt, a first apron, and a second apron. The first and second aprons are connected to the thrust-side and anti-thrust-side skirts through connecting sections. Each connecting section has a thickness that gradually increases as followed from a proximal longitudinal end to a distal longitudinal end, wherein the proximal longitudinal end is closer to the piston crown, and the distal longitudinal end is closer to a distal longitudinal end of a corresponding one of the thrust-side and anti-thrust-side skirts.

5 Claims, 8 Drawing Sheets

INTERNAL COMBUSTION ENGINE PISTON

BACKGROUND OF THE INVENTION

The present invention relates to internal combustion engine pistons which may be adapted to motor vehicles.

In an internal combustion engine, a piston is subject to high combustion pressure, and thereby subject to a side force because of inclination of a connecting rod with respect to the piston. The side force presses the piston on a cylinder wall, and causes a large frictional force between a thrust-side skirt of the piston and the cylinder wall. Accordingly, internal combustion engine pistons are designed to bear such side forces, and reduce such frictional forces. On the other hand, there is demand for weight reduction of internal combustion engine pistons.

Japanese Patent Application Publication No. 2008-190357 discloses an internal combustion engine piston which includes a thrust-side skirt, an anti-thrust-side skirt, and a pair of aprons between the thrust-side skirt and the anti-thrust-side skirt, where each connecting section between one of the skirts and one of the aprons is formed with a stress dispersing portion for dispersing a stress that is concentrated in the connecting section due to difference in thermal expansion and elastic deformation between the skirt and the apron.

SUMMARY OF THE INVENTION

In the internal combustion engine piston according to Japanese Patent Application Publication No. 2008-190357, each stress dispersing portion is implemented by a projection which extends outwardly from a lower end portion of the corresponding skirt. This can enhance the rigidity of the lower end portion of the skirt locally, and thereby cause the rigidity of the entire skirt to be uneven. The contact pressure between each skirt and the cylinder wall can be locally high due to the uneven rigidity, so that the piston can be subject to a large frictional force.

In view of the foregoing, it is desirable to provide an internal combustion engine piston which is capable of solving the problem described above.

According to one aspect of the present invention, an internal combustion engine piston comprises: a piston crown defining a combustion chamber; a thrust-side skirt formed integrally with the piston crown, and adapted to be in sliding contact with a cylinder wall, the thrust-side skirt having an arc-shaped cross-section; an anti-thrust-side skirt formed integrally with the piston crown, and adapted to be in sliding contact with the cylinder wall, the anti-thrust-side skirt having an arc-shaped cross-section; a first apron formed with a first piston pin boss; a second apron formed with a second piston pin boss; a first connecting section connecting the first apron to a first circumferential end of the thrust-side skirt; a second connecting section connecting the second apron to a second circumferential end of the thrust-side skirt; a third connecting section connecting the first apron to a first circumferential end of the anti-thrust-side skirt; and a fourth connecting section connecting the second apron to a second circumferential end of the anti-thrust-side skirt, wherein each of the first, second, third and fourth connecting sections has a thickness that gradually increases as followed from a proximal longitudinal end to a distal longitudinal end, wherein the proximal longitudinal end is closer to the piston crown, and the distal longitudinal end is closer to a distal longitudinal end of a corresponding one of the thrust-side and anti-thrust-side skirts. The internal combustion engine piston may be configured so that: each of the first, second, third and fourth connecting sections has an arc-shaped cross-section whose radius of curvature gradually increases as followed from the proximal longitudinal end to the distal longitudinal end in a piston longitudinal direction; and an inside surface of each of the first, second, third and fourth connecting sections has a larger radius of curvature than an outside surface of the each of the first, second, third and fourth connecting sections at the distal longitudinal end. The internal combustion engine piston may be configured so that: each of the first and second aprons has a curved cross-section; and each of the first and second connecting sections or each of the third and fourth connecting sections includes a projection located at the distal longitudinal end, wherein the projection extends inwardly substantially in a piston radial direction. The internal combustion engine piston may be configured so that: each of the first and second aprons has a curved cross-section; and each of the first and second connecting sections includes a projection located at the distal longitudinal end, wherein the projection extends inwardly substantially in a piston radial direction. The internal combustion engine piston may be configured so that: each of the first and second aprons has a curved cross-section; and each of the first, second, third and fourth connecting sections includes a projection located at the distal longitudinal end, wherein the projection extends inwardly substantially in a piston radial direction.

According to another aspect of the present invention, an internal combustion engine piston comprises: a piston crown defining a combustion chamber; a thrust-side skirt formed integrally with the piston crown, and adapted to be in sliding contact with a cylinder wall, the thrust-side skirt having an arc-shaped cross-section; an anti-thrust-side skirt formed integrally with the piston crown, and adapted to be in sliding contact with the cylinder wall, the anti-thrust-side skirt having an arc-shaped cross-section; a first apron formed with a first piston pin boss; a second apron formed with a second piston pin boss; a first connecting section connecting the first apron to a first circumferential end of the thrust-side skirt; a second connecting section connecting the second apron to a second circumferential end of the thrust-side skirt; a third connecting section connecting the first apron to a first circumferential end of the anti-thrust-side skirt; and a fourth connecting section connecting the second apron to a second circumferential end of the anti-thrust-side skirt, wherein at least one of the thrust-side and anti-thrust-inside skirts is formed so that rigidity of the at least one of the thrust-side and anti-thrust-side skirts is substantially uniform from a proximal longitudinal end to a distal longitudinal end, wherein the proximal longitudinal end is closer to the piston crown than the distal longitudinal end.

According to a further aspect of the present invention, an internal combustion engine piston comprises: a piston crown defining a combustion chamber; a thrust-side skirt formed integrally with the piston crown, and adapted to be in sliding contact with a cylinder wall, the thrust-side skirt having an arc-shaped cross-section; an anti-thrust-side skirt formed integrally with the piston crown, and adapted to be in sliding contact with the cylinder wall, the anti-thrust-side skirt having an arc-shaped cross-section; a first apron formed with a first piston pin boss; a second apron formed with a second piston pin boss; a first connecting section connecting the first apron to a first circumferential end of the thrust-side skirt; a second connecting section connecting the second apron to a second circumferential end of the thrust-side skirt; a third connecting section connecting the first apron to a first circumferential end of the anti-thrust-side skirt; and a fourth connecting section connecting the second apron to a second circumferential end of the anti-thrust-side skirt, wherein at least one of the thrust-side and anti-thrust-side skirts is formed so that deformation of the at least one of the thrust-side and anti-thrust-side skirts is substantially uniform from a proximal longitudinal to a distal longitudinal end in a piston longitudinal direction while the at least one of the thrust-side and anti-thrust-side skirts is sliding in contact with the cylinder wall during piston stroke, wherein the proximal longitudinal end is closer to the piston crown than the distal longitudinal end.

DETAILED DESCRIPTION OF THE INVENTION

Internal combustion engine pistons according to first to third embodiments of the present invention are adapted to four-cycle gasoline engines.

First Embodiment

Figure 7:
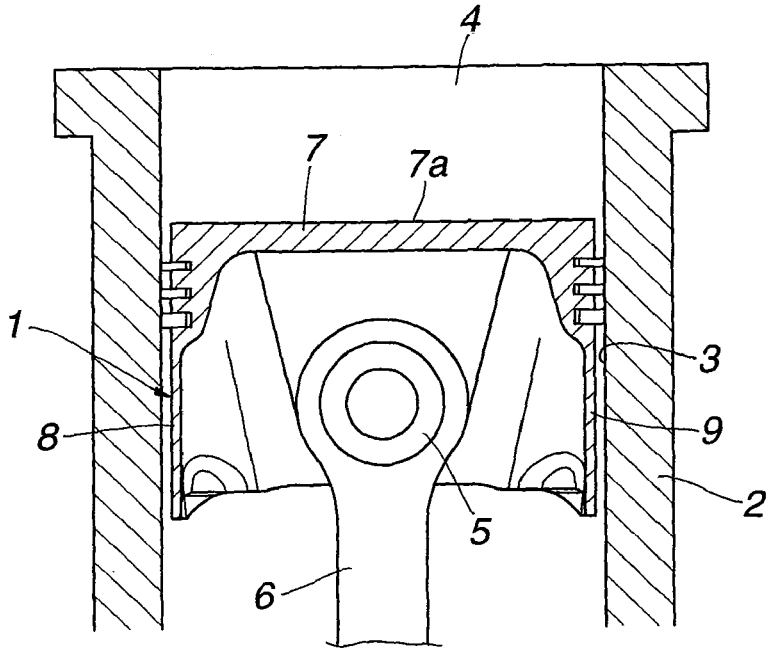
FIG. 7 is a side sectional view of the internal combustion engine piston in sliding contact with a cylinder wall in a cylinder block.

As shown in FIG. 7, a piston 1 is provided in a cylindrical bore formed in a cylinder block 2, so that piston 1 is in sliding contact with a cylinder wall 3 of the bore. Piston 1, cylinder wall 3, and cylinder head not shown define a combustion chamber 4. Piston 1 is linked to a crankshaft not shown through a piston pin 5 and a connecting rod 6.

Piston 1 is formed integrally from an Al—Si aluminum alloy, AC8A, by casting. As shown in FIGS. 1A to 4, piston 1 has a cylindrical shape, which is formed with a piston crown 7 defining the combustion chamber 4 on a crown top 7*a*; a thrust-side skirt 8 formed integrally with a periphery of a lower end portion of piston crown 7, and adapted to be in sliding contact with cylinder wall 3, wherein thrust-side skirt 8 has an arc-shaped cross-section as viewed in the longitudinal direction of piston 1; an anti-thrust-side skirt 9 formed integrally with the periphery of the lower end portion of piston crown 7, and adapted to be in sliding contact with cylinder wall 3, wherein anti-thrust-side skirt 9 has an arc-shaped cross-section as viewed in the longitudinal direction of piston 1; a first apron 11 formed with a first piston pin boss 13; a second apron 12 formed with a second piston pin boss 14; a first connecting section 10 connecting the first apron 11 to a first circumferential end of thrust-side skirt 8; a second connecting section 10 connecting the second apron 12 to a second circumferential end of thrust-side skirt 8; a third connecting section 10 connecting the first apron 11 to a first circumferential end of anti-thrust-side skirt 9; and a fourth connecting section 10 connecting the second apron 12 to a second circumferential end of anti-thrust-side skirt 9.

Piston crown 7 is in the form of a relatively thick disc. Piston crown 7 is formed with valve recesses not shown in crown top 7*a* for preventing interference with intake and exhaust valves, and also with ring grooves 7*b*, 7*c* and 7*d* in the periphery for retaining three piston rings such as a pressure ring and an oil ring.

Thrust-side and anti-thrust-side skirts 8 and 9 are arranged symmetrically with respect to a plane passing through a central longitudinal axis of piston 1. Each of thrust-side and anti-thrust-side skirts 8 and 9 has an arc-shaped cross-section whose thickness is relatively thin substantially entirely. When piston 1 is traveling toward a bottom dead center position, for example, on expansion stroke, thrust-side skirt 8 is pressed on cylinder wall 3 with an inclination resulting from a relationship in angle between piston 1 and connecting rod 6. On the other hand, when piston 1 is traveling toward a top dead center position, for example, on compression stroke, anti-thrust-side skirt 9 is pressed on cylinder wall 3 with an opposite inclination resulting from the relationship in angle between piston 1 and connecting rod 6. In general, the force pressing the thrust-side skirt 8 on cylinder wall 3 is larger than the force pressing the anti-thrust-side skirt 9 on cylinder wall 3, because thrust-side skirt 8 is subject to combustion pressure.

Figure 2:
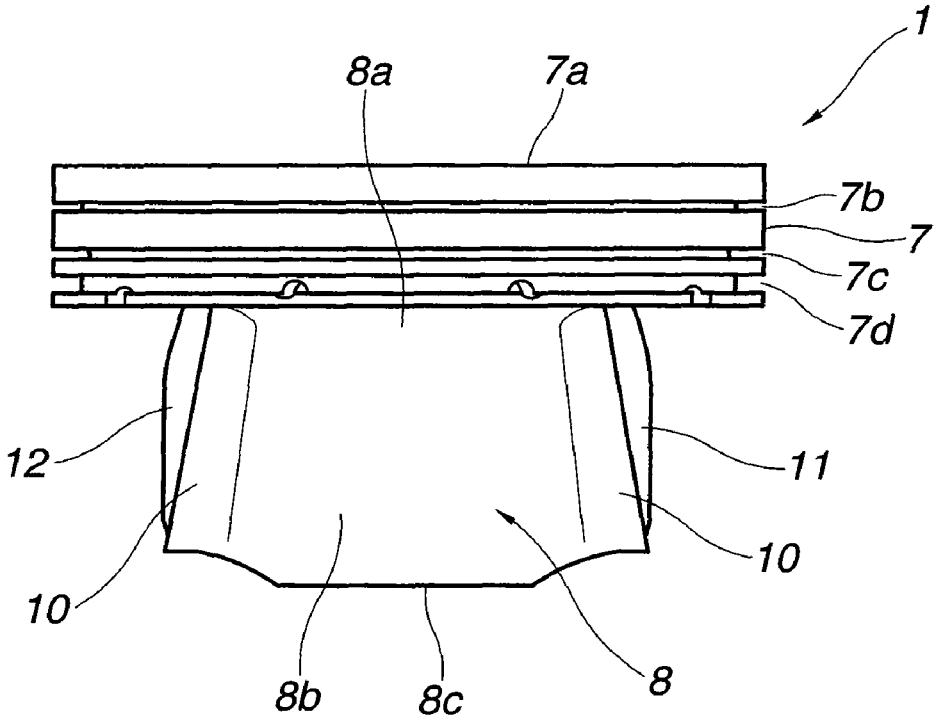
FIG. 2 is a side view of the internal combustion engine piston according to the first embodiment.
Figure 3:
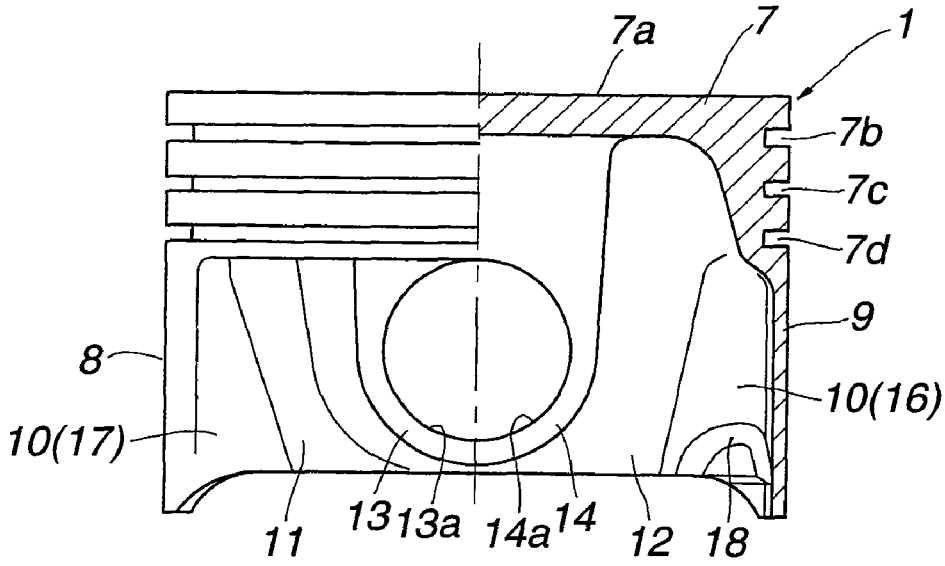
FIG. 3 is a partially cutaway front view of the internal combustion engine piston according to the first embodiment.

Each of thrust-side and anti-thrust-side skirts 8 and 9 has a trapezoidal side section with inclined edges as viewed from the front side of thrust-side or anti-thrust-side skirt 8 or 9, as shown in FIG. 2. Namely, the width of each of thrust-side and anti-thrust-side skirts 8 and 9 increases as followed from an upper end portion 8*a* or 9*a* to a lower end portion 8*b* or 9*b*. Each of thrust-side and anti-thrust-side skirts 8 and 9 is formed with a substantially flat lower end edge 8*c* or 9*c*.

Each apron 11 or 12 has an upper end formed integrally with the lower end of piston crown 7, and has a curved cross-section that is slightly curved outwardly as viewed in the longitudinal direction of piston 1. The radius of curvature of the cross-section of apron 11 or 12 is set larger than that of thrust-side or anti-thrust-side skirt 8 or 9, for example, set to about from 150-300 mm. As shown in FIG. 2, aprons 11 and 12 are formed to extend with inclination with respect to the longitudinal axis of piston 1, so that aprons 11 and 12 spread as followed from the upper end to the lower end. The thickness of the cross-section of each apron 11 or 12 is relatively large. Each apron 11 or 12 is formed with piston pin boss 13 or 14 substantially at the center in the circumferential direction of piston 1. Each piston pin boss 13 or 14 includes a piston pin hole 13*a* or 14*a* which supports one of the longitudinal ends of piston pin 5.

Figure 5:
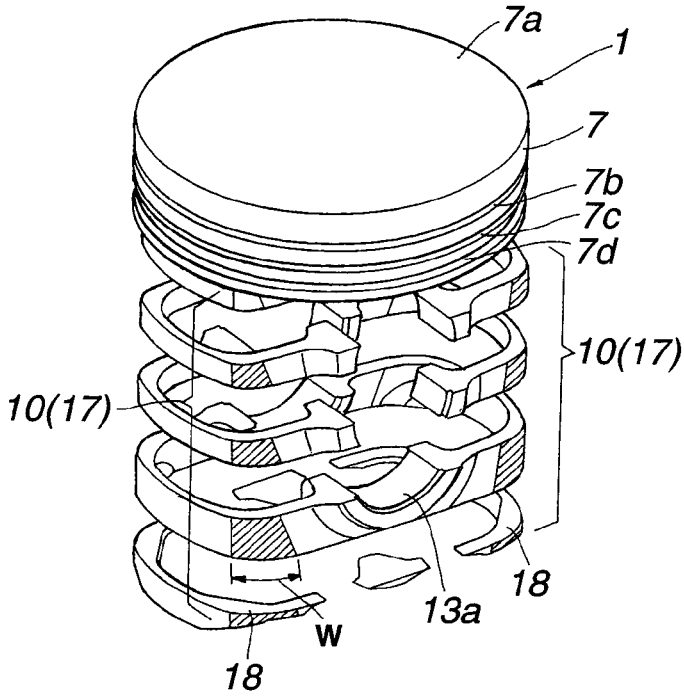
FIG. 5 is a perspective view of the internal combustion engine piston according to the first embodiment, where skirts and aprons are shown in the form of separated sections, and outside surfaces of connecting sections are indicated by hatching pattern.
Figure 6:
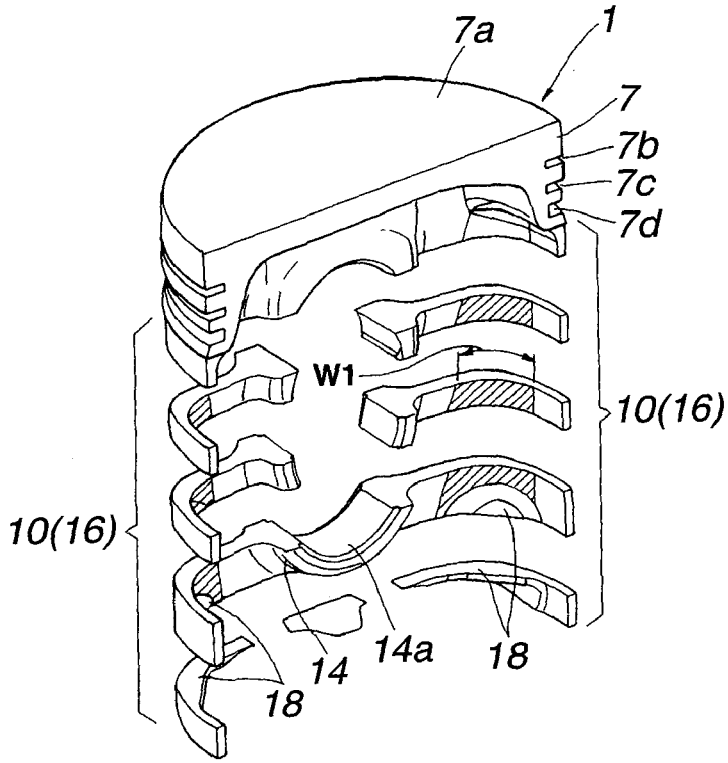
FIG. 6 is a partially cutaway perspective view of the internal combustion engine piston according to the first embodiment, where the skirts and aprons are shown in the form of separated sections, and inside surfaces of connecting sections are indicated by hatching pattern.

Each connecting section 10 has an arc-shaped cross-section as viewed in the longitudinal direction of piston 1, extending between apron 11 or 12 and thrust-side or anti-thrust-side skirt 8 or 9 in the circumferential direction of piston 1. As indicated by hatching pattern in FIGS. 1A and 6, an inside surface 16 of connecting section 10 has a radius of curvature that gradually and continuously increases as followed from an upper end portion 16*a* to a lower end portion 16*b* in the longitudinal direction of piston 1. Similarly, as indicated by hatching pattern in FIGS. 1A and 5, an outside surface 17 of connecting section 10 has a radius of curvature that gradually and continuously increases as followed from an upper end portion 17*a* to a lower end portion 17*b* in the longitudinal direction of piston 1. Specifically, the radius of curvature of each of inside and outside surfaces 16 and 17 is set to increase continuously and linearly from about 10 mm to about 30 mm as followed from upper end portion 16*a* or 17*a* to lower end portion 16*b* or 17*b* in the longitudinal direction of piston 1.

The arc width W of inside surface 16 and the arc width W1 of outside surface 17 change as followed in the piston longitudinal direction, where the rate of change of the arc width W is different from that of the arc width W1. Specifically, the arc width W of outside surface 17 is set relatively small, and the rate of change from upper end portion 17*a* to lower end portion 17*b* is set relatively small. On the other hand, the arc width W1 of inside surface 16 is set relatively large, and the rate of change from upper end portion 16*a* to lower end portion 16*b* is set relatively large as compared to outside surface 17. Accordingly, the thickness of connecting section 10 gradually increases as followed from a proximal longitudinal end to a distal longitudinal end, where the proximal longitudinal end is closer to piston crown 7, and the distal longitudinal end is closer to a distal longitudinal end (lower end edge 8*c* or 9*c*) of a corresponding one of thrust-side and anti-thrust-side skirts 8 and 9. The substantially flat shape of inside surface 16 of connecting section 10 is effective for setting the rigidity of thrust-side and anti-thrust-side skirts 8 and 9 to be substantially uniform entirely, i.e. both in the circumferential direction and in the piston longitudinal direction.

Figure 1A:
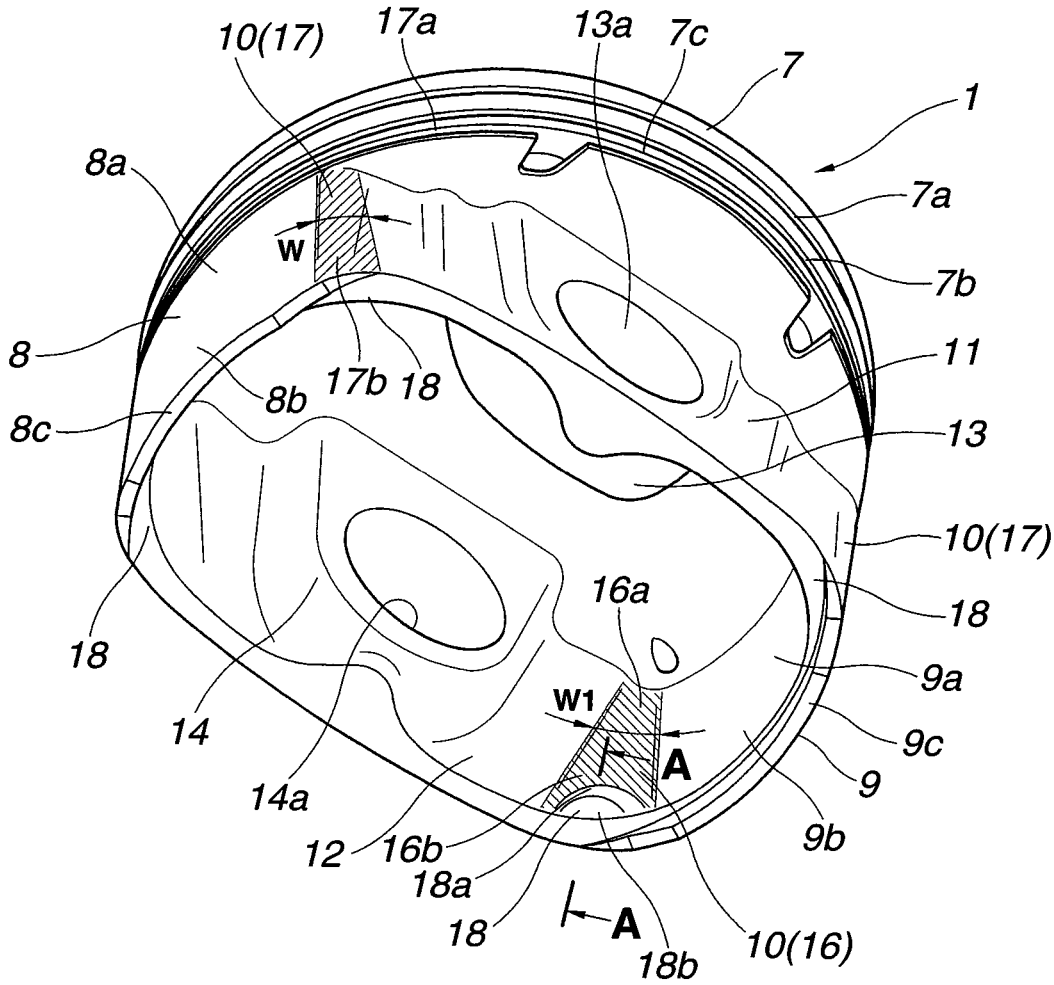
FIG. 1A is a perspective view of an internal combustion engine piston according to a first embodiment of the present invention from its bottom side.
Figure 4:
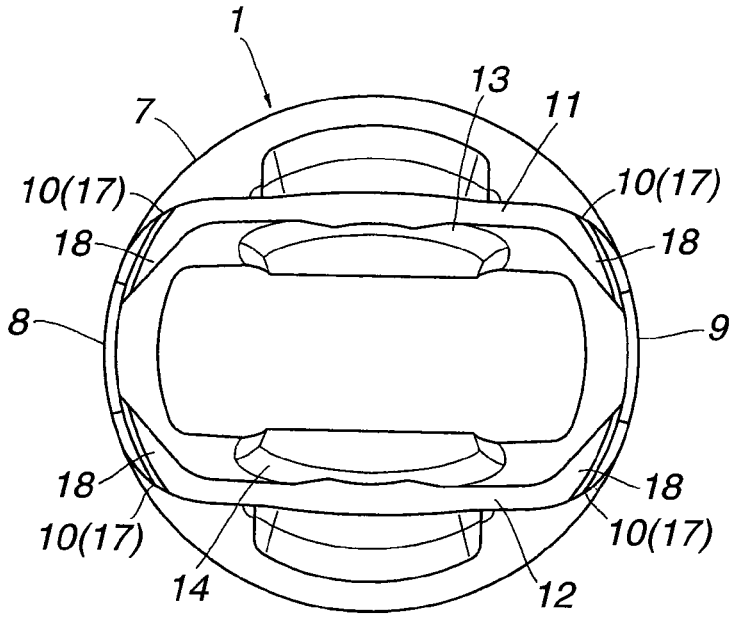
FIG. 4 is a bottom view of the internal combustion engine piston according to the first embodiment.

The shapes of thrust-side and anti-thrust-side skirts 8 and 9, connecting sections 10, and aprons 11 and 12 constitute a truncated cone shape with an elliptic cross-section as viewed from the bottom side, as shown in FIGS. 1A, 2 and 4.

Figure 1B:
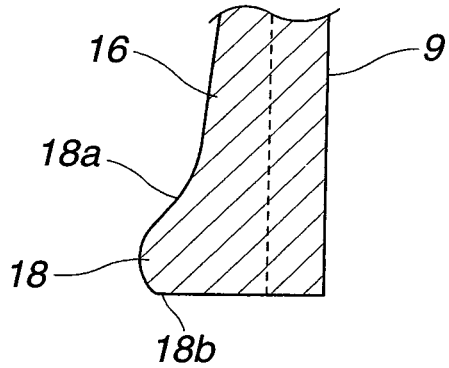
FIG. 1B is an enlarged partial side-sectional view of the internal combustion engine piston taken along the line A-A in FIG. 1A.

The inside surface 16 of each connecting section 10 is formed with a projection 18 locally at lower end portion 16*b*. As shown in FIG. 1B, each projection 18 is formed integrally with the lower end portion 16*b* of inside surface 16 of connecting section 10, where projection 18 has an arc-shaped inside surface, and a lower edge which is the thickest and flush with the lower edge of inside surface 16. The thickness of projection 18 is set to decrease as followed upwardly from lower end edge 18*b*. An upper end edge 18*a* of projection 18 is smoothly and continuously connected to lower end portion 16*b* of inside surface 16.

The provision of projection 18 is effective for enhancing the rigidity of the lower edge of thrust-side or anti-thrust-side skirt 8 or 9 that is a free end, and thereby setting the rigidity of thrust-side or anti-thrust-side skirt 8 or 9 more uniform.

With the arc-shaped cross-section, each connecting section 10 functions as a spring to suppress deformation of thrust-side or anti-thrust-side skirt 8 or 9, when thrust-side or anti-thrust-side skirt 8 or 9 is pressed on cylinder wall 3 during reciprocating motion of piston 1. Moreover, aprons 11 and 12, which have curved cross-sections, also function as springs, although the effect of aprons 11 and 12 is smaller than that of connecting sections 10. In this way, connecting sections 10, and aprons 11 and 12 serve to increase the contact area between thrust-side or anti-thrust-side skirt 8 or 9 and cylinder wall 3, and thereby prevent the contact pressure therebetween from locally increasing. In other words, thrust-side and anti-thrust-side skirts 8 and 9, connecting sections 10, and aprons 11 and 12 form a substantially elliptic cross-section as viewed in the longitudinal direction of piston 1, where connecting sections 10 and aprons 11 and 12 function as a spring so as to absorb or disperse or suppress the contact pressure applied to thrust-side or anti-thrust-side skirt 8 or 9.

The feature that the radius of curvature of connecting section 10 gradually increases as followed from upper end portions 16*a* and 17*a* to lower end portions 16*b* and 17*b*, is effective for setting the rigidity of thrust-side or anti-thrust-side skirt 8 or 9 at the circumferential ends connected to apron 11 or 12 to be uniform in the piston longitudinal direction. If the thickness of connecting section 10 is uniform between upper end portion 16*a* or 17*a* and lower end portion 16*b* or 17*b*, the rigidity gradually decreases from upper end portion 16*a* or 17*a* and lower end portion 16*b* or 17*b*, because the lower end portion 16*b* or 17*b* is a free end. This decrease is cancelled by the foregoing feature. In this way, the feature is effective for providing uniform contact between thrust-side or anti-thrust-side skirt 8 or 9 and cylinder wall 3, and thereby reducing the contact pressure and the friction therebetween.

The provision of projection 18 is effective for further enhancing the rigidity of the lower end portion of thrust-side or anti-thrust-side skirt 8 or 9. Since the lower end portion 8*b* or 9*b* of thrust-side or anti-thrust-side skirt 8 or 9 is a free end, the rigidity of the lower end portion 8*b* or 9*b* tends to be relatively low. However, projection 18 serves to further enhance the rigidity of lower end portion 9*b* in addition to the effective shape of connecting section 10, and thereby set the rigidity of thrust-side or anti-thrust-side skirt 8 or 9 uniform. This is effective for providing uniform contact between thrust-side or anti-thrust-side skirt 8 or 9 and cylinder wall 3, mainly in the piston longitudinal direction, and thereby reducing the contact pressure and the friction therebetween.

Figure 8:
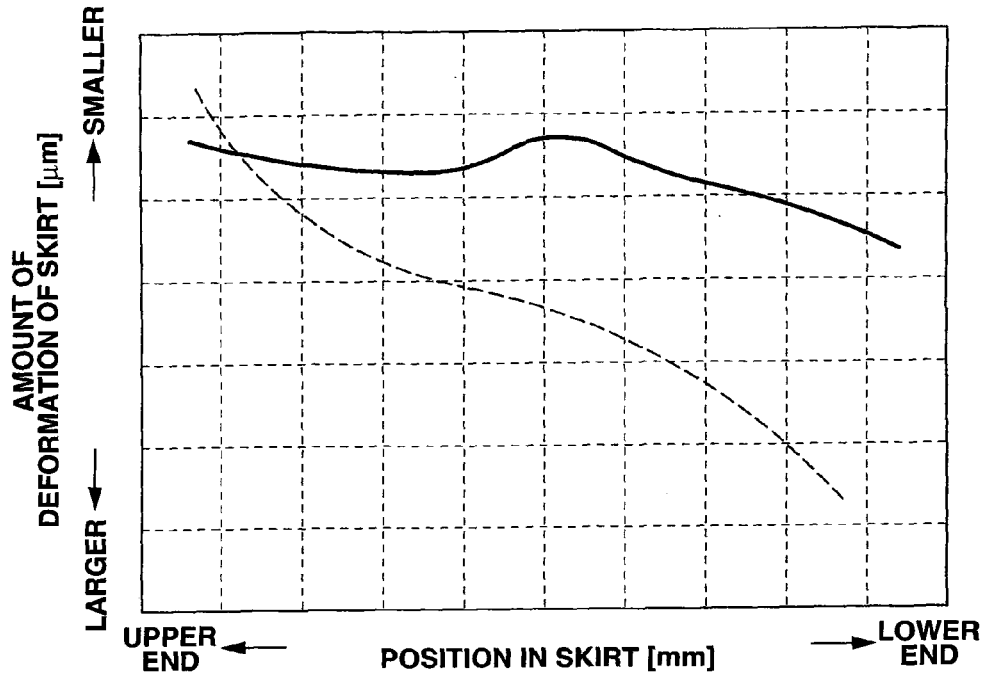
FIG. 8 is a graphic diagram showing the amount of deformation of a thrust-side skirt with respect to a position in the thrust-side skirt in a case of the internal combustion engine piston according to the first embodiment and in a case of an internal combustion engine piston according to a reference example.

FIG. 8 shows a result of an experiment in which the amount of deformation of a thrust-side skirt at a point between the upper end and the lower end is measured under the same condition that the thrust-side skirt is in contact with cylinder wall 3 on expansion stroke, in a case of piston 1 according to the first embodiment which is indicated by a solid line, and in a case of a piston according to a reference example which is indicated by a broken line. In the piston according to the reference example, the amount of deformation significantly increases as the position moves from the upper end to the lower end. In contrast, in piston 1 according to the present embodiment, the amount of deformation is smaller and more uniform all over the range between the upper end and the lower end, although it is slightly relatively large at a position slightly below the upper end, and at or near the lower end. This is achieved because the characteristic shape of connecting section 10, and the provision of projection 18 serve to set the rigidity of thrust-side skirt 8 substantially uniform entirely. In this way, thrust-side or anti-thrust-side skirt 8 or 9 is formed so that deformation of thrust-side or anti-thrust-side skirt 8 or 9 is substantially uniform from a proximal longitudinal to a distal longitudinal end in a piston longitudinal direction while thrust-side or anti-thrust-side skirt 8 or 9 is sliding in contact with cylinder wall 3 during piston stroke, wherein the proximal longitudinal end is closer to piston crown 7 than the distal longitudinal end.

Figure 9:
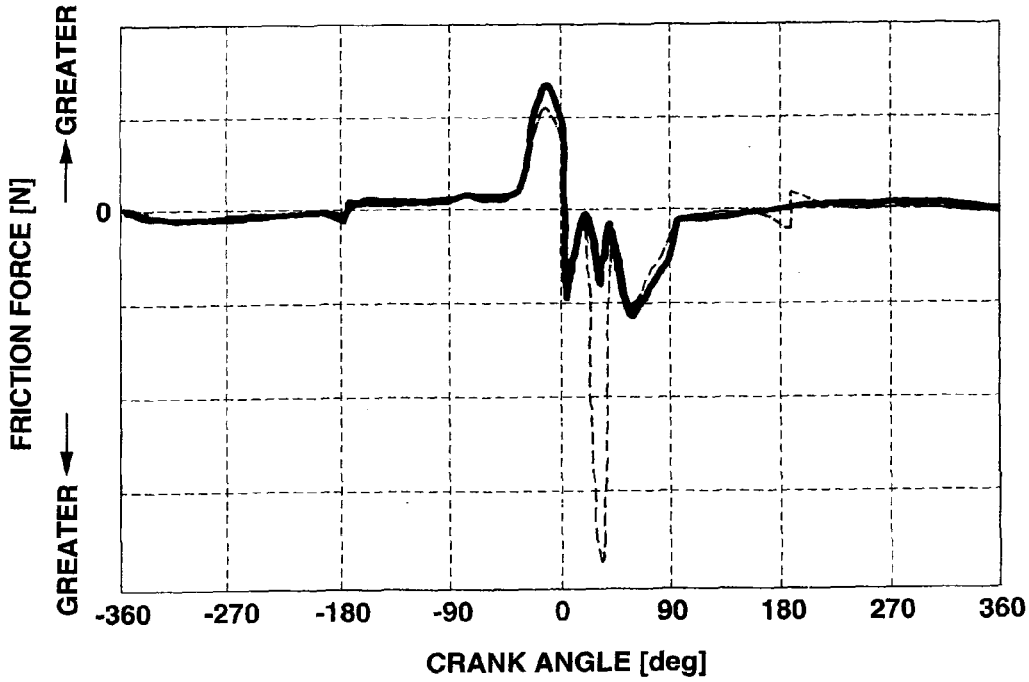
FIG. 9 is a graphic diagram showing a frictional force with respect to a crank angle in a case of the internal combustion engine piston according to the first embodiment and in a case of the internal combustion engine piston according to the reference example.

FIG. 9 shows a history of a frictional force applied to a piston which is calculated by numerical analysis in the case of piston 1 according to the present embodiment, and in the case of the piston according to the reference example. The horizontal axis represents the crank angle, whereas the vertical axis represents the frictional force. As shown in FIG. 9, the frictional force in the present embodiment indicated by a solid line is smaller than in the reference example indicated by a broken line, specifically in the range of about 0 to 90 degrees. This is achieved by the characteristic structure of piston 1.

Second Embodiment

Figure 10:
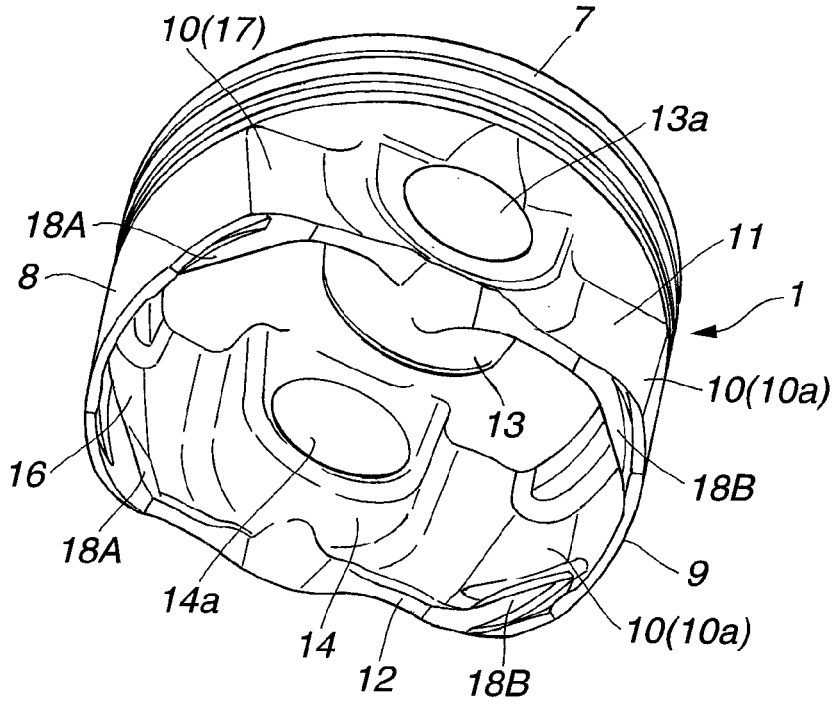
FIG. 10 is a perspective view of an internal combustion engine piston according to a second embodiment of the present invention from its bottom side.
Figure 11:
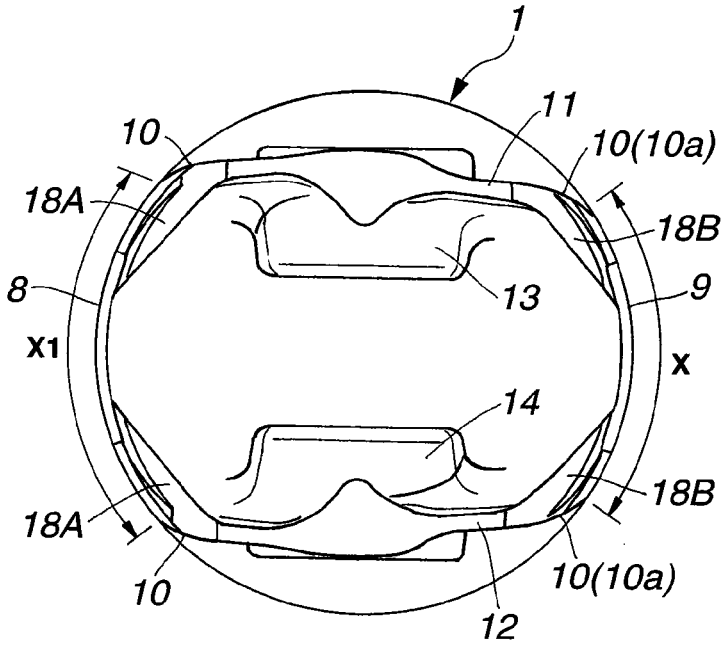
FIG. 11 is a bottom view of the internal combustion engine piston according to the second embodiment.

FIGS. 10 and 11 show a second embodiment in which thrust-side and anti-thrust-side skirts 8 and 9 are formed and arranged asymmetrically with respect to the plane passing through the central longitudinal axis of piston 1. Specifically, the circumferential length X of anti-thrust-side skirt 9 is set shorter than the circumferential length X1 of thrust-side skirt 8. Namely, the contact area of anti-thrust-side skirt 9 with cylinder wall 3 is set smaller than that of thrust-side skirt 8. This is because the pressing force applied to anti-thrust-side skirt 9 is smaller than the pressing force applied to thrust-side skirt 8.

The radius of curvature of each of two connecting sections 10 closer to thrust-side skirt 8 is set equal to that in the first embodiment. On the other hand, the radius of curvature of each of two connecting sections 10*a* closer to anti-thrust-side skirt 9 is set smaller than that of connecting sections 10 closer to thrust-side skirt 8.

Moreover, the thickness, and circumferential length of each of projections 18B closer to anti-thrust-side skirt 9 are set smaller than those of projections 18A closer to thrust-side skirt 8 or than those in the first embodiment.

On the other hand, the curved shapes of aprons 11 and 12 are the same as in the first embodiment.

The second embodiment is effective for reducing the total weight of piston 1 because of compactness of parts closer to anti-thrust-side skirt 9, while producing the same advantageous effects as in the first embodiment.

Third Embodiment

Figure 12:
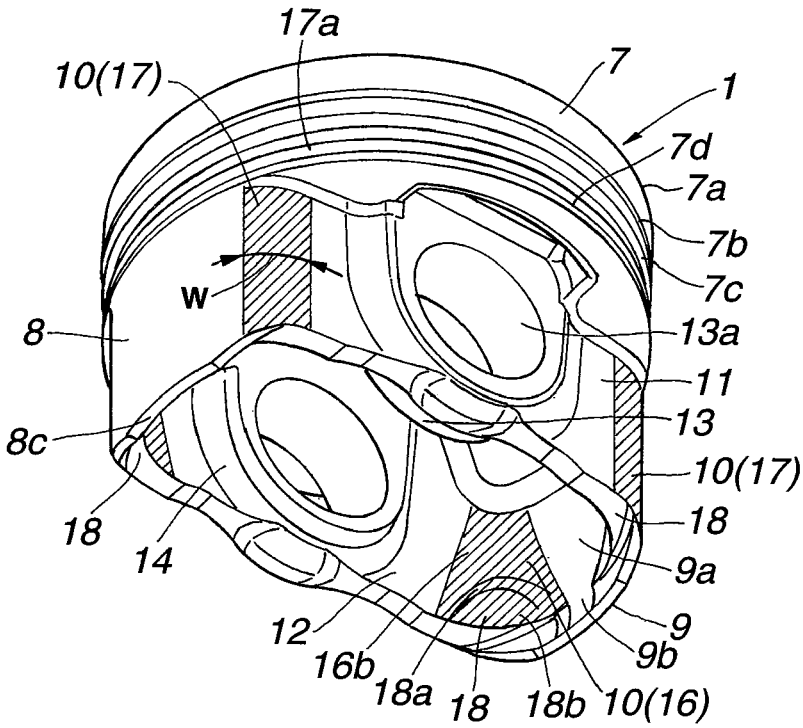
FIG. 12 is a perspective view of an internal combustion engine piston according to a third embodiment of the present invention from its bottom side.
Figure 13:
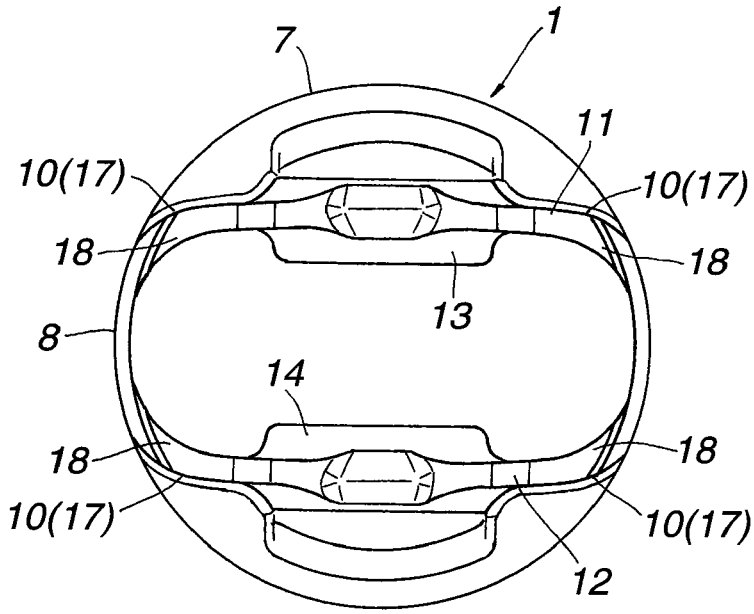
FIG. 13 is a bottom view of the internal combustion engine piston according to the third embodiment.
Figure 14:
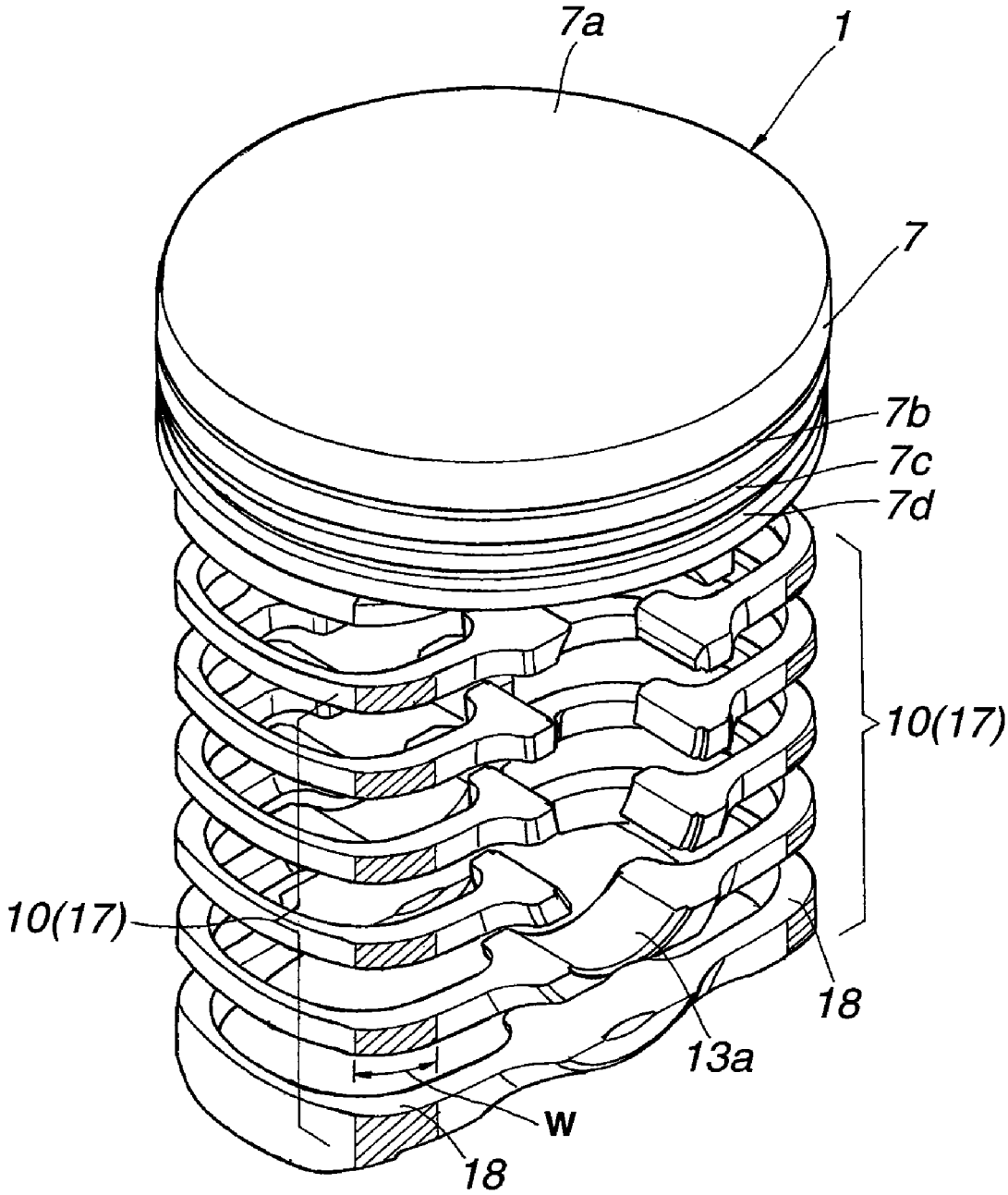
FIG. 14 is a perspective view of the internal combustion engine piston according to the third embodiment, where skirts and aprons are shown in the form of separated sections, and outside surfaces of connecting sections are indicated by hatching pattern.

FIGS. 12 to 14 show a third embodiment created based on the first and second embodiments, in which each apron 11 or 12 is curved slightly outwardly as viewed in FIG. 13, extending in parallel to the longitudinal axis of piston 1 with no inclination. Namely, aprons 11 and 12 are arranged in parallel to each other, in contrast to the aprons according to the first embodiment which constitute a truncated cone shape with a trapezoidal side-section.

The radius of curvature of outside surface 17 of connecting section 10 is substantially constant all over the range from the upper end to the lower end. In contrast, the radius of curvature of inside surface 16 of connecting section 10 is set to increase gradually as followed from upper end portion 16*a* to lower end portion 16*b*.

In this embodiment, the curved shapes of aprons 11 and 12 serve as springs, as in the first embodiment. Moreover, in connecting section 10, the feature that the radius of curvature of outside surface 17 is substantially constant from the upper end to the lower end, and the radius of curvature of inside surface 16 increases significantly from the upper end to the lower end, serves to set the thickness of the lower end portion of connecting section 10 larger enough than that of the upper end portion, and thereby set the rigidity of thrust-side or anti-thrust-side skirt 8 or 9 substantially uniform.

The shapes and spring functions of aprons 11 and 12, and connecting sections 10 serve to suppress unevenness of the rigidity of thrust-side and anti-thrust-side skirts 8 and 9, and thereby suppress unevenness of the contact pressure between cylinder wall 3 and thrust-side or anti-thrust-side skirt 8 or 9.

Each apron 11 or 12 is not limited to a curved cross-section, but may have a substantially flat cross-section as viewed in the longitudinal direction of piston 1. In such a case, when thrust-side or anti-thrust-side skirt 8 or 9 is pressed on cylinder wall 3, connecting section 10 mainly serves as a spring, while aprons 11 and 12 do not serve as springs very well.

The present invention is not limited to the first to third embodiments, and may be embodied so that only thrust-side skirt 8 is provided with connecting sections 10 and anti-thrust-side skirt 9 is provided with no connecting sections 10, where thrust-side skirt 8 is generally subject to high contact load.

Connecting section 10 is not limited to an arc-shaped cross-section as viewed in the longitudinal direction of piston 1, and may have a curved cross-section formed by chamfering.

The outside surfaces of thrust-side and anti-thrust-side skirts 8 and 9 may be coated with a low-friction material, in order to reduce the friction between cylinder wall 3 and thrust-side or anti-thrust-side skirt 8 or 9.

The material of piston 1 is not limited to aluminum alloys, but may be formed of one of various materials such as iron and magnesium.

The piston may be adapted to various internal combustion engines such as single-cylinder types, and multiple-cylinder types, such as V-types, and W-types.

The entire contents of Japanese Patent Application 2009-058839 filed Mar. 12, 2009 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An internal combustion engine piston comprising:

a piston crown defining a combustion chamber;

a thrust-side skirt formed integrally with the piston crown, and adapted to be in sliding contact with a cylinder wall, the thrust-side skirt having an arc-shaped cross-section;

an anti-thrust-side skirt formed integrally with the piston crown, and adapted to be in sliding contact with the cylinder wall, the anti-thrust-side skirt having an arc-shaped cross-section;

a first apron formed with a first piston pin boss;

a second apron formed with a second piston pin boss, the first and second aprons having a substantially constant thickness in a direction from top to bottom;

a first connecting section connecting the first apron to a first circumferential end of the thrust-side skirt;

a second connecting section connecting the second apron to a second circumferential end of the thrust-side skirt;

a third connecting section connecting the first apron to a first circumferential end of the anti-thrust-side skirt; and a fourth connecting section connecting the second apron to a second circumferential end of the anti-thrust-side skirt, wherein each of the first, second, third and fourth connecting sections has a thickness that gradually increases as followed from a proximal longitudinal end to a distal longitudinal end, wherein the proximal longitudinal end is closer to the piston crown, and the distal longitudinal end is closer to a distal longitudinal end of a corresponding one of the thrust-side and anti-thrust-side skirts.

2. The internal combustion engine piston as claimed in claim 1, wherein:

each of the first, second, third and fourth connecting sections has an arc-shaped cross-section whose radius of curvature gradually increases as followed from the proximal longitudinal end to the distal longitudinal end in a piston longitudinal direction; and an inside surface of each of the first, second, third and fourth connecting sections has a larger radius of curvature than an outside surface of the each of the first, second, third and fourth connecting sections at the distal longitudinal end.

3. The internal combustion engine piston as claimed in claim 1, wherein:

each of the first and second aprons has a curved cross-section; and each of the first and second connecting sections or each of the third and fourth connecting sections includes a projection located at the distal longitudinal end, wherein the projection extends inwardly substantially in a piston radial direction.

4. The internal combustion engine piston as claimed in claim 1, wherein:

each of the first and second aprons has a curved cross-section; and each of the first and second connecting sections includes a projection located at the distal longitudinal end, wherein the projection extends inwardly substantially in a piston radial direction.

5. The internal combustion engine piston as claimed in claim 1, wherein:

each of the first and second aprons has a curved cross-section; and each of the first, second, third and fourth connecting sections includes a projection located at the distal longitudinal end, wherein the projection extends inwardly substantially in a piston radial direction.

* * * * *